US010364484B2

(12) United States Patent
Donahue et al.

(10) Patent No.: US 10,364,484 B2
(45) Date of Patent: Jul. 30, 2019

(54) METHOD AND ALLOYS FOR LOW PRESSURE PERMANENT MOLD WITHOUT A COATING

(71) Applicant: Brunswick Corporation, Lake Forest, IL (US)

(72) Inventors: Raymond J. Donahue, Fond du Lac, WI (US); Alexander K. Monroe, Fond du Lac, WI (US); Kevin R. Anderson, Fond du Lac, WI (US); Terrance M. Cleary, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 67 days.

(21) Appl. No.: 15/471,668

(22) Filed: Mar. 28, 2017

(65) Prior Publication Data

US 2018/0282842 A1 Oct. 4, 2018

(51) Int. Cl.
*B22D 18/04* (2006.01)
*B22D 21/04* (2006.01)
(Continued)

(52) U.S. Cl.
CPC ..... *C22C 21/02* (2013.01); *B22C 9/065* (2013.01); *B22D 18/04* (2013.01); *B22D 21/007* (2013.01);
(Continued)

(58) Field of Classification Search
CPC ..... B22C 9/06; B22C 9/065; B22D 18/04; B22D 21/007; B22D 21/04; B22D 27/04
(Continued)

(56) References Cited

U.S. PATENT DOCUMENTS 7,347,905 B1 3/2008 Donahue et al.
7,666,353 B2 2/2010 Donahue et al.
(Continued)

FOREIGN PATENT DOCUMENTS

| | | |
|---|---|---|
| CN | 102676885 | 6/2015 |
| EP | 1683881 | 7/2006 |
| WO | 2008/144935 | 12/2008 |

OTHER PUBLICATIONS

European Search Report, EP Patent Application No. 18163110.2, dated Aug. 3, 2018.
(Continued)

*Primary Examiner* — Kevin P Kerns
(74) *Attorney, Agent, or Firm* — Andrus Intellectual Property Law, LLP

(57) ABSTRACT

A method and alloys for low pressure permanent mold casting without a coating are disclosed. The method includes preparing a permanent mold casting die that is devoid of die coating or lubrication along the die surface, preparing a permanent mold casting alloy, pushing the alloy into the die under low pressure, cooling the permanent mold casting, and removing the casting from the die. One alloy has 4.5-11.5% by weight silicon; 0.45% by weight maximum iron; 0.20-0.40% by weight manganese; 0.045-0.110% by weight strontium; 0.05-5.0% by weight copper; 0.01-0.70% by weight magnesium; and the balance aluminum. Another alloy has 4.2-5.0% by weight copper; 0.005-0.45% by weight iron; 0.20-0.50% by weight manganese; 0.15-0.35% by weight magnesium; 0.045-0.110% by weight strontium; 0.50% by weight maximum nickel; 0.10% by weight maximum silicon; 0.15-0.30% by weight titanium; 0.05% by weight maximum tin; 0.10% by weight maximum zinc; and the balance aluminum.

13 Claims, 13 Drawing Sheets
(5 of 13 Drawing Sheet(s) Filed in Color)

(51) Int. Cl.

| | |
|---|---|
| ***B22D 27/04*** | (2006.01) |
| ***B22C 9/06*** | (2006.01) |
| ***C22C 21/02*** | (2006.01) |
| ***B22D 21/00*** | (2006.01) |
| ***C22C 21/04*** | (2006.01) |
| ***C22C 21/12*** | (2006.01) |
| ***C22C 21/16*** | (2006.01) |
| ***C22F 1/043*** | (2006.01) |
| ***C22F 1/057*** | (2006.01) |

(52) U.S. Cl.
CPC ..... *B22D 21/04* (2013.01); *B22D 27/04* (2013.01); *C22C 21/04* (2013.01); *C22C 21/12* (2013.01); *C22C 21/16* (2013.01); *C22F 1/043* (2013.01); *C22F 1/057* (2013.01)

(58) Field of Classification Search
USPC ..... 164/120, 122, 131, 76.1
See application file for complete search history.

(56) References Cited

U.S. PATENT DOCUMENTS

2012/0000578 A1* 1/2012 Wang et al. ..... C22C 21/02 148/549
2012/0148444 A1* 6/2012 Nagaishi et al. ..... C22C 21/02 420/534

OTHER PUBLICATIONS

J. R. Davis, "Aluminum and Aluminum Alloys", Dec. 31, 2001, XP055429982, retrieved from the Internet, https://materialsdata.nist.gov/bitstretam/handle/11115/173/Aluminum and Aluminum Alloys Davis.pdf, retrieved on Nov. 29, 2017.
J. C. Jaquet et al., "Einfluss einzelner Zusatzelemente auf das Gefuege und die Eigenschften einer AlCu-Legierung. T.2", Aluminum, 57, 3, Jan. 1, 2981, p. 205, XP055494534, retrieved from the Internet, https://www.tib.eu/en/search/id/tema-archive%ATEMAW81000363UDS/Einglufxx-einzelner-Zusatzelemente-auf-das-Gefuege, retrieved on Jul. 23, 2018.
Partial European Search Report and Written Opinion, EP Patent Application No. 18163110.2, dated May 25, 2018.
Adam Kopper et al., Solder Resistance Mechanisms of Novel Al—Sr—Si Die Casting Alloys, Light Metals, Warrendale, PA, pp. 801-802, Coden: LMPMDF; ISSN:0147-, dated Jan. 1, 2006, XP009150752.
Elcee Group, Gravity Die Casting and Low Pressure Die Casting, dated Jun. 26, 2015, XP055477035, http://www.elcee.nl/wp-content/uploaded/2015/06, retrieved on May 22, 2018.
"Aluminum and Aluminum Alloys", ASM Specialty Handbook, 1993, pp. 113-114.
"Designations and Chemical Composition Limits for Aluminum Alloys in the form of Castings and Ingots", Aluminum Association, 2008.

* cited by examiner

Measured Result

| Meas Cont | Meas Value |
|---|---|
| Roughness 2D<SurfAnalysis_1> Profile=R_ISO - Section =[1] | |
| Ra | 127.781uinch |
| Ramax | 179.854uinch |
| Rq | 160.519uinch |
| Rqmax | 242.210uinch |
| Rsk | -0.17 |
| Rskmax | 0.49 |
| Rku | 3.00 |
| Rkumax | 4.36 |
| Rp | 343.081uinch |
| Rpmax | 491.588uinch |
| Rv | 430.045uinch |
| Rvmax | 839.843uinch |
| Rz | 773.126uinch |
| Rzmax | 1331.430uinch |
| Rt | 1331.430uinch |
| Rc3 | 402.255uinch |
| Rc3max | 424.581uinch |
| RSm3 | 0.0087inch |
| RSm3max | 0.0110inch |
| Rdq | 0.22 |
| Rdqmax | 0.25 |
| Rk | 417.283uinch |
| Rpk | 175.532uinch |
| Rvk | 214.295uinch |
| Mr1 | 7.18% |
| Mr2 | 90.35% |
| A1 | 629.914uinch% |
| A2 | 1034.062uinch% |
| Rz1max | 1331.430uinch |
| RPc3 | 45.23 |

Measured Result

| Meas Cont | Meas Value |
|---|---|
| Roughness 2D<SurfAnalysis_1> | |
| Profile=R_ISO - Section =[1] | |
| Ra | 119.572uinch |
| Ramax | 179.871uinch |
| Rq | 150.694uinch |
| Rqmax | 236.052uinch |
| Rsk | -0.41 |
| Rskmax | 0.91 |
| Rku | 3.41 |
| Rkumax | 4.13 |
| Rp | 313.523uinch |
| Rpmax | 450.469uinch |
| Rv | 449.962uinch |
| Rvmax | 791.539uinch |
| Rz | 763.485uinch |
| Rzmax | 1242.008uinch |
| Rt | 1242.008uinch |
| Rc | 499.108uinch |
| Rcmax | 785.735uinch |
| RSm | 0.0101inch |
| RSmmax | 0.0140inch |
| Rdq | 0.21 |
| Rdqmax | 0.27 |
| Rk | 314.043uinch |
| Rpk | 141.265uinch |
| Rvk | 272.036uinch |
| Mr1 | 9.94% |
| Mr2 | 85.63% |
| A1 | 702.374uinch% |
| A2 | 1954.283uinch% |
| Rz1max | 1242.008uinch |
| RPc | 38.86 |

Measured Result

| Meas Cont | Meas Value |
|---|---|
| Roughness 2D<SurfAnalysis_1> | |
| Profile=R_ISO - Section =[1] | |
| Ra | 92.874uinch |
| Ramax | 114.877uinch |
| Rq | 112.027uinch |
| Rqmax | 136.061uinch |
| Rsk | 0.09 |
| Rskmax | 0.54 |
| Rku | 2.54 |
| Rkumax | 2.78 |
| Rp | 246.329uinch |
| Rpmax | 322.670uinch |
| Rv | 247.187uinch |
| Rvmax | 354.711uinch |
| Rz | 493.516uinch |
| Rzmax | 586.196uinch |
| Rt | 677.381uinch |
| Rc | 346.182uinch |
| Rcmax | 447.359uinch |
| RSm | 0.0086inch |
| RSmmax | 0.0124inch |
| Rdq | 0.18 |
| Rdqmax | 0.21 |
| Rk | 299.666uinch |
| Rpk | 125.101uinch |
| Rvk | 91.075uinch |
| Mr1 | 12.38% |
| Mr2 | 93.53% |
| A1 | 774.131uinch% |
| A2 | 294.654uinch% |
| Rz1max | 586.196uinch |
| RPc | 46.00 |

Measured Result

| Meas Cont | Meas Value |
|---|---|
| Roughness 2D<SurfAnalysis_1> Profile=R_ISO - Section =[1] | |
| Ra | 402.272uinch |
| Ramax | 496.075uinch |
| Rq | 497.348uinch |
| Rqmax | 606.031uinch |
| Rsk | -0.17 |
| Rskmax | 0.34 |
| Rku | 2.58 |
| Rkumax | 3.12 |
| Rp | 869.519uinch |
| Rpmax | 1027.148uinch |
| Rv | 1230.495uinch |
| Rvmax | 1310.160uinch |
| Rz | 2100.014uinch |
| Rzmax | 2333.523uinch |
| Rt | 2337.308uinch |
| Rc | 1671.104uinch |
| Rcmax | 2333.523uinch |
| RSm | 0.0124inch |
| RSmmax | 0.0178inch |
| Rdq | 0.49 |
| Rdqmax | 0.51 |
| Rk | 1242.203uinch |
| Rpk | 287.313uinch |
| Rvk | 655.203unich |
| Mr1 | 9.55% |
| Mr2 | 88.29% |
| A1 | 1371.640uinch% |
| A2 | 3836.667uinch |
| Rz1max | 2333.623uinch |
| RPc | 31.79 |

Measured Result

| Meas Cont | Meas Value |
|---|---|
| Roughness 2D<SurfAnalysis_1> | |
| Profile=R_ISO - Section =[1] | |
| Ra | 468.502uinch |
| Ramax | 666.761uinch |
| Rq | 607.029uinch |
| Rqmax | 875.407uinch |
| Rsk | 0.07 |
| Rskmax | 1.16 |
| Rku | 3.09 |
| Rkumax | 3.36 |
| Rp | 1277.620uinch |
| Rpmax | 1840.012uinch |
| Rv | 1446.993uinch |
| Rvmax | 1894.144uinch |
| Rz | 2724.612uinch |
| Rzmax | 3550.439uinch |
| Rt | 3734.157uinch |
| Rc | 2013.991uinch |
| Rcmax | 2587.835uinch |
| RSm | 0.0157inch |
| RSmmax | 0.0202inch |
| Rdq | 0.53 |
| Rdqmax | 0.66 |
| Rk | 1220.399uinch |
| Rpk | 797.609uinch |
| Rvk | 978.592uinch |
| Mr1 | 14.59% |
| Mr2 | 87.18% |
| A1 | 5817.827uinch% |
| A2 | 5271.509uinch% |
| Rz1max | 3550.439uinch |
| RPc | 25.02 |

METHOD AND ALLOYS FOR LOW PRESSURE PERMANENT MOLD WITHOUT A COATING

FIELD

This application is in the filed of metallurgy, and directed more particularly to the casting of metallic objects using the permanent mold casting process.

BACKGROUND

In general, aluminum castings are produced by more than a few casting processes depending on economic considerations, quality requirements and technical considerations. Although there are many specialized casting processes, including investment casting (also called lost wax), lost foam casting, centrifugal casting, plaster mold casting, ceramic mold casting, squeeze casting, semi-solid casting, and its variate slurry-on-demand casting, the three main casting processes are sand casting, permanent mold casting and high pressure die casting.

Sand Casting uses insulating sand molds resulting in a relatively slow cooling rate. The microstructural features, such as grain size or the aluminum dendritic arm spacing, are relatively large with the expectation that mechanical properties are lower because of the inverse relationship between the size of microstructural features and mechanical properties. Because of these features and properties, the quality of the casting is considered relatively low. Very small and very large castings up to several tons can be produced in sand casting in quantities ranging from only one to a few thousand. In high volume scenarios, sand castings are the most expensive because the sand mold has to be replicated for every casting. In low volume scenarios, the tooling cost per part is lower for sand casting than it is for permanent mold or high pressure die casting.

Permanent mold casting (whether gravity or low pressure) uses a metal mold or die with a coating to provide a barrier between the steel die and molten aluminum alloys to control and limit the heat extraction from the molten metal. Because of the variable thickness of the coating, the coating is frequently also responsible for a non-chemical sticking of the casting in the coated die requiring human intervention or monitoring as the casting is extracted from the die. Thus, the low pressure permanent mold process is not fully automated, unlike high pressure die casting. In some instances, water lines in the dies are used to control and increase heat extraction. The water can be provided at a given temperature and at a given flow rate or alternatively oil can be substituted for the water. As a result, when compared with the sand casting slow cooling rates, the permanent mold cooling rates are significantly higher, resulting in premium quality castings with smaller grain size, smaller aluminum dendrite arm spacing, and higher mechanical properties. In permanent mold casting, medium size castings up to 100 kg may be produced in quantities of from 1,000 to 100,000. As a result, cost on a per pound basis is lower cost than a sand casting because the albeit expensive permanent mold tooling may be used to make 100,000 castings or more. The steel dies are coated with a coating to prevent the molten alloy from soldering to the die during the casting process. The coating on the dies produces a surface finish on the casting that replicates the rough, undesirable topography of the coating. This rough finish often requires a secondary operation to obtain a smoother surface finish. In low pressure permanent mold casting, a molten alloy is pushed into the mold in the range of 3-15 psi.

Permanent mold casting (whether gravity or low pressure) produces parts with the highest mechanical properties because it is the only casting process that permits an economical, full T6 heat treatment. This solution heat treatment results in a homogenized microstructure while avoiding blistering. In high pressure die casting, solution heat treating times and temperatures must be significantly lowered to avoid "blistering" from trapped die release agents or air. In sand casting, by contrast, longer solution heat treating times and temperatures must be applied to homogenize the otherwise coarse microstructure and obtain the highest mechanical properties after solution heat treating and artificial aging. The surface finish in permanent mold casting, however, does not match the surface smoothness of either sand casting or die casting because the coating on the dies in permanent mold casting replicates the rough topography of the coating.

High pressure die casting uses uncoated dies and injects molten metal at high velocities into a die cavity with pressure intensification on the molten metal during solidification. Partly because of the turbulent filling, but primarily because of the high iron content (of about 1%) required for die soldering resistance, the quality of die castings and the mechanical properties of die castings are lower than both permanent mold casting and sand castings, despite the smaller grain size and smaller aluminum dendrite arm spacing. High pressure die castings are typically small castings up to about 50 kg. The tooling for high pressure die casting is expensive and is expected to produce large quantities of castings in the range of 10,000 to 100,000. Thus, the cost per pound of high pressure die castings are lower than permanent mold or sand casting.

Structural aluminum die casting refers to high pressure die casting with a low iron content. In structural aluminum die casting, high levels of manganese are typically used instead of iron to provide die soldering resistance. The Silafont™-36 alloy uses a manganese maximum of 0.80%, while the Aural™-2 alloy and Aural™-3 alloy both use a manganese maximum of 0.60%. Conventional copper containing Aluminum Association registered die casting alloys 380, A380, B380, C380, D380, E380, 381, 383, A383, B383, 384, A384, B384, and C384 all contain a manganese maximum of 0.50%, and are considered low quality alloys made from scrap. These lowest quality die casting alloys cannot be used as structural aluminum die casting alloys because the manganese is too high. It is commonly believed that manganese is the most important element in any die casting alloy because the manganese determines the iron level below which Mn/Fe-intermetallics do not form, according to quaternary Al-Si-Fe-Mn phase diagrams from the reference Solidification Characteristics of Aluminum Alloys, Vol. 2—Foundry Alloys by Lennard Backerud, Guocai Chai, Jamo Tamminen, 1990 AFS Book. At 0.1% manganese, the iron should be less than 0.7% to avoid the primary precipitation of intermetallics that decrease mechanical properties, particularly the ductility. Thus, to avoid the primary precipitation of intermetallics at 0.2% Mn, the iron should be less than 0.6%; at 0.3% Mn, the iron should be less than 0.5%; at 0.4% Mn, the iron should be less than 0.4%; at 0.5% Mn, the iron should be less than 0.3%; at 0.6% Mn, the iron should be less than 0.2%; at 0.7% Mn, the iron should be less than 0.1%; and finally at 0.8% Mn, the iron should be less than 0%—an impossibility. None of the conventional die casting alloys noted above meets the manganese and iron requirements to avoid the primary precipitation of intermetallics. Further, this means the Silafont™-36 alloy at 0.8% Mn with an Aluminum Association specification limit for iron at 0.12% Fe (which is quite low), will still precipitate intermetallics that decrease ductility. However, the Aural™-2 alloy and Aural™-3 alloy at 0.6% Mn with an Aluminum Association specification limit for iron at 0.25% may have a lesser tendency to precipitate intermetallics than the Silafont™-36 alloy because the iron limit to avoid the primary precipitation is below 0.20% when Mn is 0.6%.

This die soldering solution for high pressure die casting does not work for the low pressure permanent mold casting process. This is because iron and/or manganese, which is used exclusively in high pressure die casting for die soldering resistance (at bulk levels as high as 1.3% and 2%), cannot be used for die soldering resistance in the slower cooling, low pressure permanent mold casting process, because the primary precipitated intermetallics would grow larger during solidification than in die casting and have a more significant effect on decreasing mechanical properties.

SUMMARY

It has been discovered that strontium at one tenth the concentration of either iron or manganese provides die soldering resistance equivalent to either iron or manganese. In that regard, see U.S. Pat. Nos. 7,347,905 and 7,666,353, incorporated herein by reference. Such structural Aluminum Die Casting alloys, such as alloys 367, 368 and 362, that rely on strontium at 0.05 to 0.08% for die soldering resistance and have a manganese range of 0.25% to 0.35%, do not precipitate primary intermetallics on solidification under any conditions, if the iron is less than 0.45%.

The present application contemplates a method and alloys for low pressure permanent mold casting without a coating. The method for low pressure permanent mold casting of metallic objects includes the step of preparing a permanent mold casting die. The permanent mold casting die is devoid of die coating or lubrication along the die casting surface. Such die coating or lubrication is not necessary because the alloys of the present invention are discovered to not solder to the permanent mold casting dies and may be pushed through even thin-walled sections of a permanent mold casting without the need for lubrication. The method next contemplates preparing a permanent mold Al—Si casting alloy having 4.5-11.5% by weight silicon; 0.45% by weight maximum iron; 0.20-0.40% by weight manganese; 0.045-0.110% by weight strontium; 0.05-5.0% by weight copper; 0.01-0.70% by weight magnesium; and the balance aluminum. In some embodiments the alloy may further include up to 0.50% by weight maximum nickel. In other embodiments, the step of preparing a permanent mold casting alloy contemplates preparing an Al—Cu permanent mold casting alloy having 4.2-5.0% by weight copper; 0.005-0.45% by weight iron; 0.20-0.50% by weight manganese; 0.15-0.35% by weight magnesium; 0.045-0.110% by weight strontium; 0.50% by weight maximum nickel; 0.10% by weight maximum silicon; 0.15-0.30% by weight titanium; 0.05% by weight maximum tin; 0.10% by weight maximum zinc; and the balance aluminum.

The method next contemplates pushing the alloy into the permanent mold casting die under low pressure. The alloy may be pushed into the permanent mold casting die in a pressure range of 3-15 psi. The step of pushing the alloy into the permanent mold die under low pressure operates to create a permanent mold casting. The method contemplates cooling the permanent mold casting and removing the permanent mold casting from the permanent mold die. In the step of removing the permanent mold casting from the permanent mold die, the permanent mold casting does not solder to the permanent mold die. The surface roughness of the permanent mold casting produced by the method of the present application is ±500 microinches or better. The method of the present application also contemplates a step of heat treating the casting after the step of removing the casting from the die. The method further contemplates that the step of cooling the permanent mold casting may further comprise solidifying the alloy without the formation of primary intermetallics such as $Al_5FeSi$ or $Al_{15}(MnFe)_3Si_2$.

The method of the present application may be used to create a permanent mold casting of an L-bracket or a gear case housing with an integral splash plate, among various other complex permanent mold castings. In that regard, one embodiment, the method of the present application contemplates the step of preparing a permanent mold casting die, preparing a permanent mold casting die having at least one thin walled section. In the method of that embodiment, the step of pushing the alloy into the permanent mold casting die includes pushing the alloy into the thin walled section before the alloy solidifies.

The present application further contemplates unique alloys for the permanent mold casting process that do not solder to a permanent mold die, do not form primary intermetallics, and may be used in permanent mold casting dies without die lubricant or coatings. In one embodiment, the permanent mold casting alloy is an Al-Si alloy that consists essentially of 4.5-11.5% silicon, 0.45% by weight maximum iron; 0.20-0.40% by weight manganese; 0.045-0.110% by weight strontium; and the balance aluminum. In another embodiment, the alloy may further consist of 0.05-5.0% by weight copper. In yet another embodiment, the alloy may further consist of 0.10-0.70% by weight magnesium. In yet another embodiment, the alloy may further consist of 0.50% by weight maximum nickel. In still another embodiment, the alloy may further consist of 4.5% by weight maximum zinc.

Another permanent mold casting alloy is contemplated, this alloy being an Al—Cu permanent mold casting alloy consisting essentially of 4.2-5.0% by weight copper; 0.005-0.15% by weight iron; 0.20-0.50% by weight manganese; 0.15-0.35% by weight magnesium; 0.045-0.110% by weight strontium; 0.05% by weight maximum nickel; 0.10% by weight maximum silicon; 0.15-0.30% by weight titanium; 0.05% by weight maximum tin; 0.10% by weight maximum zinc; and the balance aluminum.

All of the alloys contemplated by the present application do not solder to the permanent mold die despite the fact that no die lubricant or coating is provided on the permanent mold casting die. Further, no intermetallics are formed during the cooling of these alloys, particularly $Al_5FeSi$ or $Al_{15}(MnFe)_3Si_2$ are not formed.

BRIEF DESCRIPTION OF THE DRAWINGS

The patent or application file contains at least one drawing executed in color. Copies of this patent or patent application publication with color drawing(s) will be provided by the Office upon request and payment of the necessary fee. The present disclosure is described with reference to the following Figures. The same numbers are used throughout the Figures to reference like features and like components.

DETAILED DESCRIPTION

Figure 1:
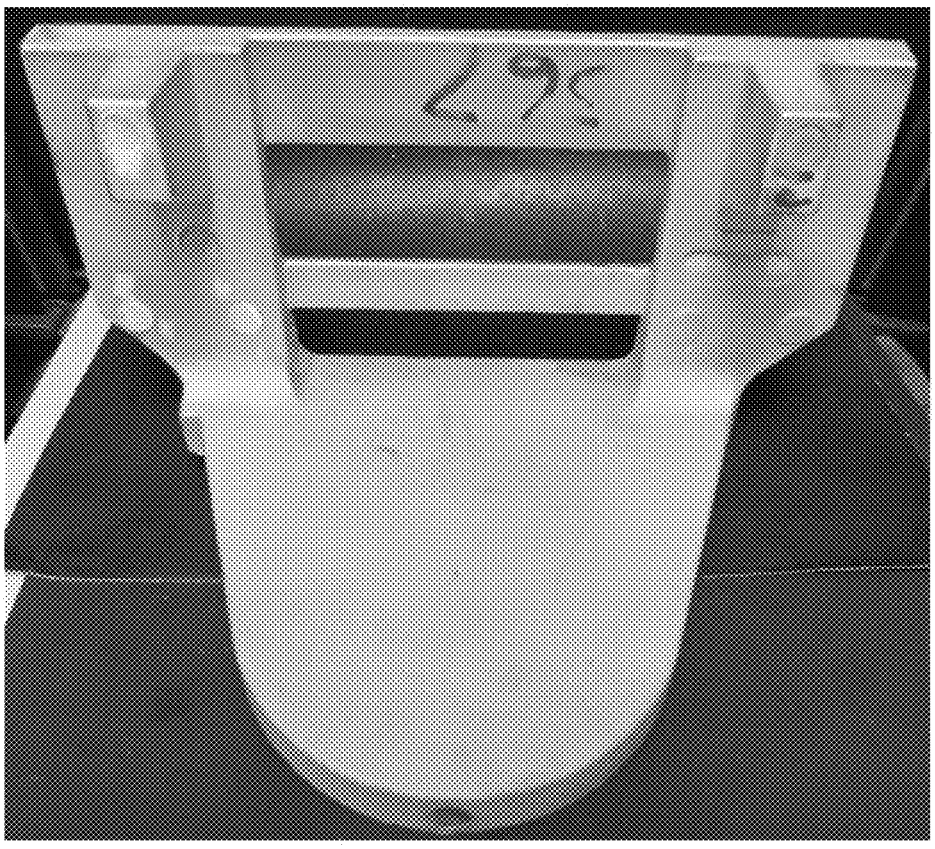
Figure 1 Prior Art
FIG. 1 is a photograph of an L-Bracket made with a traditional low pressure permanent mold casting process where a coating or lubrication is used to coat the die cavity.

The present inventors have discovered the formula to determine when permanent mold die soldering does or does not occur. That formula is:

$$(10[Sr]+Mn+Fe)>1.1$$

The result of the formula is herein referred to as the "die soldering factor." If the die soldering factor is less than 1.1, die soldering is expected to occur; conversely if the die soldering factor is greater than 1.1, then die soldering is not expected to occur.

In application, alloys 367 and 368 have a strontium (Sr) range of 0.05% to 0.08% with a midpoint of 0.065%; a manganese (Mn) range of 0.25% to 0.35% with a midpoint of 0.30%; and an iron (Fe) range of 0% to 0.25% with a midpoint of 0.125%. Applying the formula yields ([10] 0.065+0.30+0.125)=1.075. The 1.075 number is rounded up to 1.1, indicting no die soldering.

The present inventors have found that the die soldering factor may be used in converting permanent mold alloys to strontium-containing permanent mold alloys with die soldering resistance that do not precipitate primary intermetallics on solidification. Unexpectedly, such alloys may be cast in the low pressure permanent mold casting process without a coating on the dies. Absence of the coating permits a faster cooling rate, which increases the mechanical properties; promotes a shorter cycle time, which lowers the manufacturing cost; and provides a much smoother surface finish which replicates the uncoated die surface topography and not the very rough surface topography of the coating.

When die soldering resistance is provided by low levels of strontium in the range of 0.045-0.110, the total bulk concentration level of iron and manganese, the two elements that traditionally provide die soldering resistance, can be lowered ultimately benefiting the mechanical properties of the alloy. Manganese is a key element in the inventive unexpected discoveries because manganese determines the specific iron concentration below which primary Mn/Fe-intermetallics will not form. Above this concentration, intermetallics precipitate and mechanical properties decrease, particularly the ductility.

In applications where the alloy is made from A356 with iron at 0.2% and manganese at the maximum of 0.1%, die soldering will occur unless the strontium is at its upper limit of 0.08%. For alloy 362 with an iron specification max of 0.4%, under the same conditions, die soldering will occur when the strontium is below its midrange value. However, when the iron content is at 0.2%, for either alloys 367 or 368, and the manganese at its midrange, die soldering will not occur when the strontium is at or above its lower spec limit of 0.05%. When the Silafont™-36 alloy is at the specified upper limit for manganese at 0.80% and upper limit for iron at 0.12%, and if the eutectic silicon is not modified with strontium, the value of the equation yields a die soldering factor of 0.92, and die soldering is expected. Further, the Aural™-2 alloy and Aural™-3 alloy at their manganese limit of 0.6% with an iron limit of 0.25% have a die soldering factor of 0.85. Thus, die soldering is expected if the eutectic silicon is not modified. To modify the eutectic silicon, 0.03% strontium could be added to the Silafont™-36 alloy Aural™-2 alloy and Aural™-3 alloy, adding 0.3 to the die soldering factors of the three alloys and bringing the Silafont™-36 alloy to 1.22 and the Aural™-2 alloy and Aural™-3 alloy to 1.15 to avoid die soldering in permanent mold castings.

Now referring to Table 1, therein is tabulated the entire Aluminum Association permanent mold alloys listed in the February 2008 pink sheets entitled "Designations and Chemical Composition Limits for Aluminum Alloys in the Form of Castings and Ingots." The listed manganese concentration specifies the iron level below which primary intermetallics do not form, and impacts the alloy's ductility. The value of the die soldering factor is provided and as previously noted, a value equal to or greater than 1.1 indicates the absence of die soldering. While high iron levels (i.e. 0.6% by weight or greater, and preferably 0.45% by weight or greater) result in no die soldering, the high iron creates poor ductility, and is not the optimal solution.

TABLE 1

PERMANENT MOLD CANDIDATE ALLOYS AND THEIR DIE SOLDERING FACTOR VALUES

| alloy | process | Si | Fe | Cu | Mn | Mg | Die Soldering Factor | Primary Precipitation of Intermetallics |
|---|---|---|---|---|---|---|---|---|
| 308 | PM | 5.0-6.0 | 1.0 | 4.0-5.0 | 0.50 | 0.10 | 1.5 → no soldering | yes → poor ductility, like HPDC |
| 318 | PM | 5.5-6.5 | 1.0 | 3.0-4.0 | 0.50 | 0.10-0.6 | 1.5 → no soldering | yes → poor ductility, like HPDC |
| 319 | PM | 5.5-6.5 | 1.0 | 3.0-4.0 | 0.50 | 0.10 | 1.5 → no soldering | yes → poor ductility, like HPDC |
| 320 | PM | 5.0-8.0 | 1.2 | 2.0-4.0 | 0.8 | 0.05-0.6 | 2.0 → no soldering | yes → poor ductility, like HPDC |

TABLE 1-continued

PERMANENT MOLD CANDIDATE ALLOYS AND THEIR DIE SOLDERING FACTOR VALUES

| alloy | process | Si | Fe | Cu | Mn | Mg | Die Soldering Factor | Primary Precipitation of Intermetallics |
|---|---|---|---|---|---|---|---|---|
| 332 | PM | 8.5-10.5 | 1.2 | 2.0-4.0 | 0.5 | 0.50-1.5 | 1.7 → no soldering | yes → poor ductility, like HPDC |
| 333 | PM | 8.0-10.0 | 1.0 | 3.0-4.0 | 0.50 | 0.05-0.50 | 1.5 → no soldering | yes → poor ductility, like HPDC |
| 336 | PM | 11.0-13.0 | 1.2 | 0.50-1.5 | 0.35 | 0.7-1.3 | 1.55 → no soldering | yes → poor ductility, like HPDC |
| 339 | PM | 11.0-13.0 | 1.2 | 1.5-3.0 | 0.50 | 0.50-1.5 | 1.7 → no soldering | yes → poor ductility, like HPDC |
| 354 | PM | 8.6-9.4 | 0.20 | 1.6-2.0 | 0.10 | 0.40-0.6 | 0.3 → die soldering | no precipitation of intermetallics |
| 355 | PM | 4.5-5.5 | 0.6 | 1.0-1.5 | 0.50 | 0.40-0.6 | 1.1 → no soldering | yes → poor ductility, like HPDC |
| A356 | PM | 6.5-7.5 | 0.20 | 0.20 | 0.10 | 0.25-0.45 | 0.3 → die soldering; | no precipitation of intermetallics |
| 357 | PM | 6.5-7.5 | 0.15 | 0.05 | 0.03 | 0.45-0.6 | 0.18 → soldering; no precipitation of primary intermetallics | |
| 358 | PM7. | 7.6-8.6 | 0.30 | 0.20 | 0.20 | 0.40-0.6 | 0.5 → soldering; no precipitation of primary intermetallics | |
| 359 | PM | 8.5-9.5 | 0.20 | 0.20 | 0.10 | 0.50-0.7 | 0.3 → soldering; no precipitation of primary intermetallics | |
| 362 | Stru | 10.5-11.5 | 0.20 | 0.15 | 0.25-0.35 | 0.55-0.7 | 1.3, with 0.06 Sr, no soldering & no primary intermetallics | |
| 363 | PM | 4.5-6.0 | 1.1 | 2.5-3.5 | — | 0.15-0.40 | 1.1 → no soldering | yes → poor ductility, like HPDC |
| 365 | Stru | 9.5-11.5 | 0.15 | 0.03 | 0.50-0.8 | 0.10-0.50 | 1.1, with 0.015 Sr → no soldering & good ductility | |
| A365 | Stru | 9.5-11.5 | 0.25 | 0.15 | 0.40-0.6 | 0.10-0.50 | 1.0, with 0.015 Sr → almost no soldering & good ductility | |
| 366 | PM | 6.5-7.5 | 0.15 | 0.05 | 0.03 | 0.5-1.2 | 0.18 → soldering but no intermetallics & good ductility | |
| 367 | Stru | 8.5-9.5 | 0.25 | 0.25 | 0.25-0.35 | 0.30-0.50 | 1.15, with 0.06 Sr → no soldering & very good ductility | |
| 368 | Stru | 8.5-9.5 | 0.25 | 0.25 | 0.25-0.35 | 0.10-0.30 | 1.15, with 0.06 Sr → no soldering & very good ductility | |

In Table 2 below, the manganese levels of the same alloys in Table 1 have been modified to a range 0.25-0.35%, in turn modifying the iron value to 0.45% max. Thus, with the strontium added at its midrange value of 0.065 for a preferable range of 0.05-0.08, the manganese at its midrange value of 0.30 for a range of 0.25-0.35, and the iron at a conservative limit of 0.40 for better ductility, the value of the die soldering factor is (10[0.065]+0.30+0.40)=1.35. Note that the preferable range of strontium is 0.05 to 0.08% by weight, but that the compatible Sr range is 0.045 to 0.110% by weight strontium. The alloys in Table 2 are the alloys uniquely identified for low pressure permanent mold casting without a coating, by adding 0.045 to 0.11% by weight strontium.

TABLE 2

NEW PERMANENT MOLD ALLOYS WITH DIE SOLDERING RESISTANCE THAT DO NOT PRECIPITATE PRIMARY INTERMETALLICS ON SOLIDIFICATION

| Alloy | Process | Si | Fe | Sr | Cu | Mn | Mg | Die Soldering Factor | Primary Intermetallics | Dies |
|---|---|---|---|---|---|---|---|---|---|---|
| A308 | PM | 5.0-6.0 | 0.45 | 0.065 | 4.0-5.0 | 0.25-0.35 | 0.10 | 1.35 → no soldering | no → high ductility | Uncoated |
| A318 | PM | 5.5-6.5 | 0.45 | 0.065 | 3.0-4.0 | 0.25-0.35 | 0.10-0.6 | 1.35 → no soldering | no → high ductility | Uncoated |
| C319 | PM | 5.5-6.5 | 0.45 | 0.065 | 3.0-4.0 | 0.25-0.35 | 0.10 | 1.35 → no soldering | no → high ductility | Uncoated |
| A320 | PM | 5.0-8.0 | 0.45 | 0.065 | 2.0-4.0 | 0.25-0.35 | 0.05-0.6 | 1.35 → no soldering | no → high ductility | Uncoated |
| A332 | PM | 8.5-10.5 | 0.45 | 0.065 | 2.0-4.0 | 0.25-0.35 | 0.50-1.5 | 1.35 → no soldering | no → high ductility | Uncoated |
| B333 | PM | 8.0-10.0 | 0.45 | 0.065 | 3.0-4.0 | 0.25-0.35 | 0.05-0.50 | 1.35 → no soldering | no → high ductility | Uncoated |
| A336 | PM | 11.0-13.0 | 0.45 | 0.065 | 0.50-1.5 | 0.25-0.35 | 0.7-1.3 | 1.35 → no soldering | no → high ductility | Uncoated |
| A339 | PM | 11.0-13.0 | 0.45 | 0.065 | 1.5-3.0 | 0.25-0.35 | 0.50-1.5 | 1.35 → no soldering | no → high ductility | Uncoated |
| A354 | PM | 8.6-9.4 | 0.45 | 0.065 | 1.6-2.0 | 0.25-0.35 | 0.40-0.6 | 1.35 → no soldering | no → high ductility | Uncoated |
| D355 | PM | 4.5-5.5 | 0.45 | 0.065 | 1.0-1.5 | 0.25-0.35 | 0.40-0.6 | 1.35 → no soldering | no → high ductility | Uncoated |
| G356 | PM | 6.5-7.5 | 0.45 | 0.065 | 0.20 | 0.25-0.35 | 0.25-0.45 | 1.35 → no soldering | no → high ductility | Uncoated |
| G357 | PM | 6.5-7.5 | 0.45 | 0.065 | 0.05 | 0.25-0.35 | 0.45-0.6 | 1.35 → no soldering | no → high ductility | Uncoated |
| A358 | PM | 7.6-8.6 | 0.45 | 0.065 | 0.20 | 0.25-0.35 | 0.40-0.6 | 1.35 → no soldering | no → high ductility | Uncoated |
| B359 | PM | 8.5-9.5 | 0.45 | 0.065 | 0.20 | 0.25-0.35 | 0.50-0.7 | 1.35 → no soldering | no → high ductility | Uncoated |
| A362 | Stru | 10.5-11.5 | 0.45 | 0.065 | 0.15 | 0.25-0.35 | 0.55-0.7 | 1.35 → no soldering | no → high ductility | Uncoated |
| A363 | PM | 4.5-6.0 | 0.45 | 0.065 | 2.5-3.5 | 0.25-0.35 | 0.15-0.40 | 1.35 → no soldering | no → high ductility | Uncoated |
| B365 | Stru | 9.5-11.5 | 0.45 | 0.065 | 0.03 | 0.25-0.35 | 0.10-0.50 | 1.35 → no soldering | no → high ductility | Uncoated |

TABLE 2-continued

NEW PERMANENT MOLD ALLOYS WITH DIE SOLDERING RESISTANCE THAT DO NOT PRECIPITATE PRIMARY INTERMETALLICS ON SOLIDIFICATION

| Alloy | Process | Si | Fe | Sr | Cu | Mn | Mg | Die Soldering Factor | Primary Intermetallics | Dies |
|---|---|---|---|---|---|---|---|---|---|---|
| C365 | Stru | 9.5-11.5 | 0.45 | 0.065 | 0.15 | 0.25-0.35 | 0.10-0.50 | 1.35 → no soldering | no → high ductility | Uncoated |
| A366 | PM | 6.5-7.5 | 0.45 | 0.065 | 0.05 | 0.25-0.35 | 0.5-1.2 | 1.35 → no soldering | no → high ductility | Uncoated |
| A367 | Stru | 8.5-9.5 | 0.45 | 0.065 | 0.25 | 0.25-0.35 | 0.30-0.50 | 1.35 → no soldering | no → high ductility | Uncoated |
| A368 | Stru | 8.5-9.5 | 0.45 | 0.065 | 0.25 | 0.25-0.35 | 0.10-0.30 | 1.35 → no soldering | no → high ductility | Uncoated |

As noted, manganese is an important element in any alloy that uses uncoated metal molds because the manganese specifies the iron level below which detrimental primary intermetallics of $Al_5FeSi$ and $AL_{15}(MnFe)_3Si_2$ cannot form, according to the Al—Si—Mn—Fe phase diagrams of FIGS. 14A-14E.

The best heat treatment condition (i.e., as cast, T5, T6 or T7) and the best mechanical properties (i.e., ultimate strength, yield strength, or elongation) were determined to then assess the difference between low pressure permanent mold casting process, with and without a coating. A review of the mechanical properties in ASM Specialty Handbook "Aluminum and Aluminum Alloys" First printing: December 1993, Table 14, pages 113 and 114, suggest the "as cast" elongation is an acceptable measure. From Table 14 of that reference, the following Table 3 was tabulated.

TABLE 3

| PM Alloy | "As Cast" Elongation | T5 Elongation | T6 Elongation | T7 Elongation |
|---|---|---|---|---|
| 308 | 2.0% | | | |
| 319 | 2.0% | 2.0% | 2.0% | |
| 324 | 4.0% | 3.0% | 3.0% | |
| 332 | | 1.0% | | |
| 333 | 2.0% | 1.0% | 1.5% | 2.0% |
| 336 | | 0.5% | 0.5% | |
| 354 | | | 6.0% | |
| 355 | | | 4.0% | |
| 356 | 5.0% | 2.0% | 5.0% | 6.0% |
| A356 | | | 10.0% | |
| 357 | 6.0% | 4.0% | 5.0% | |
| A357 | | | 5.0% | |
| 358 | | | 6.0% | |
| 359 | | | 7.0% | |

The "as cast" condition was selected because it was nearly (but not always) the highest elongation value, with the other temper conditions generally having a lower elongation.

Figure 2:
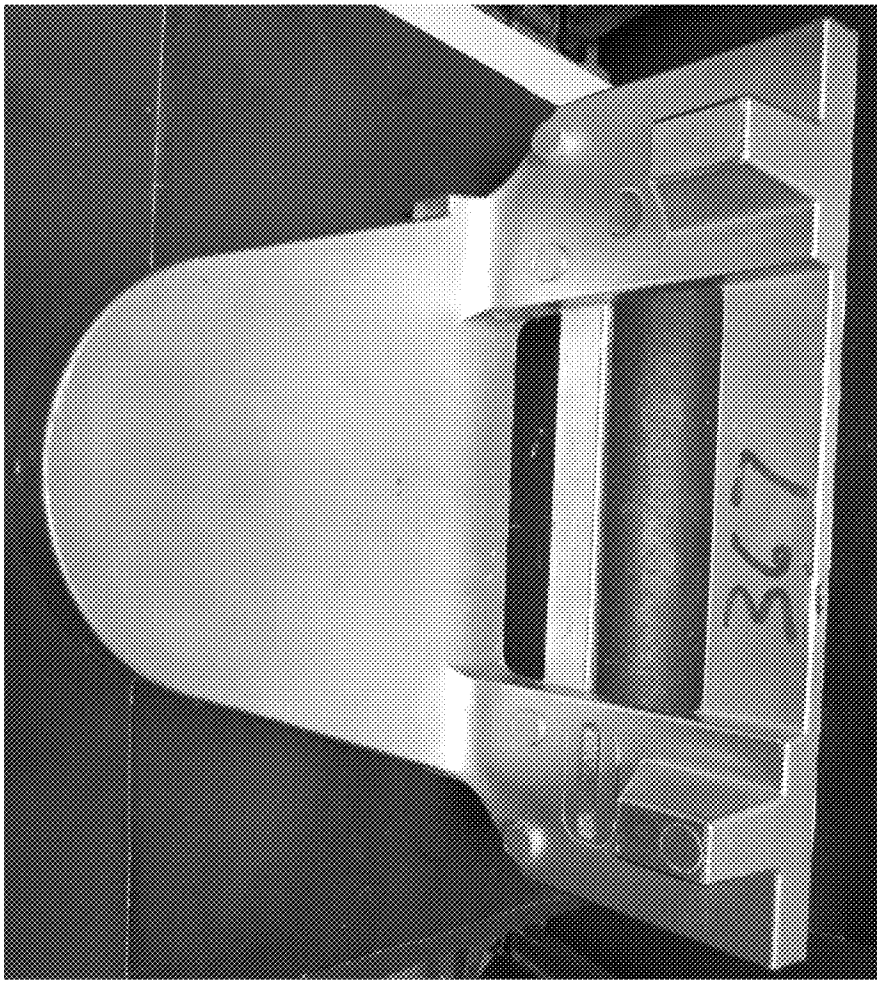
FIG. 2 is a photograph of an L-Bracket made with the new low pressure permanent mold casting process of the present application.
Figure 3:
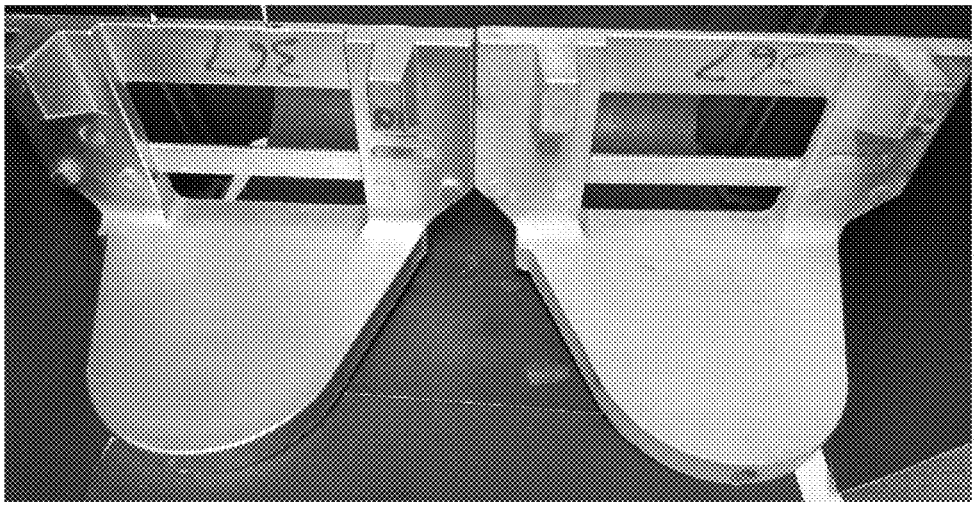
FIG. 3 is a photograph comparing the L-Brackets of FIGS. 1 and 2 in a side by side comparison.
Figure 4:
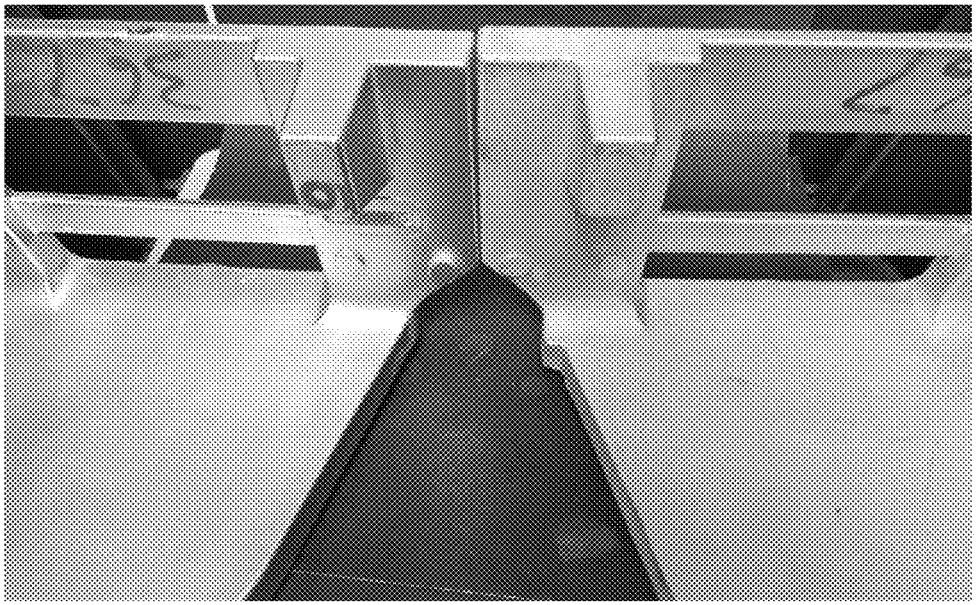
FIG. 4 is a close-up photograph of FIG. 3.

Referring to FIGS. 1 and 2, an L-bracket with a solid back and two bars for a seat as demonstrated. FIG. 1 was made in low pressure permanent mold casting with the normal coating and FIG. 2 was made in low pressure permanent mold casting without a coating. The superior aesthetics of FIG. 2 is apparent. FIGS. 3 and 4 show the L-bracket of FIGS. 1 and 2 at higher magnification, where both L-brackets are side by side. The L-bracket made without a coating is on the left, and it is apparent that the L-bracket made without a coating exhibits superior aesthetics.

Figure 5:
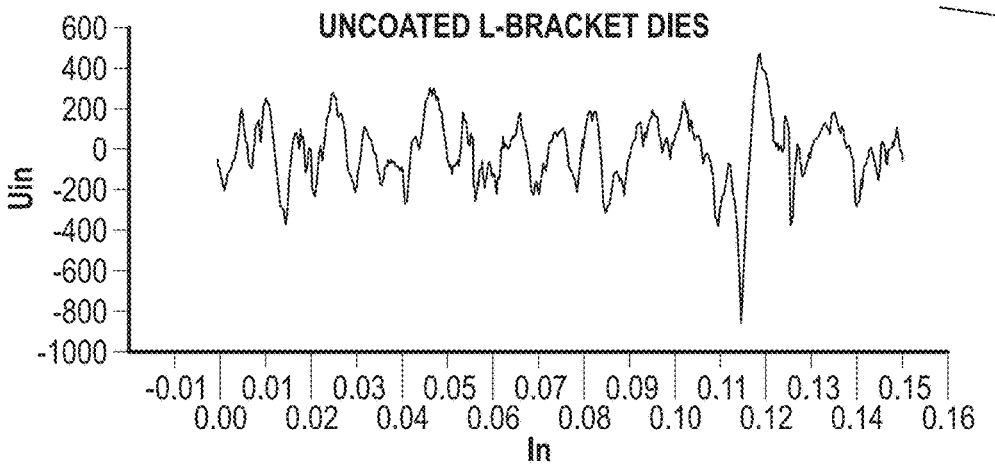
FIG. 5 is a surface roughness measurement of an L-Bracket manufactured in accordance with the present application.
Figure 6:
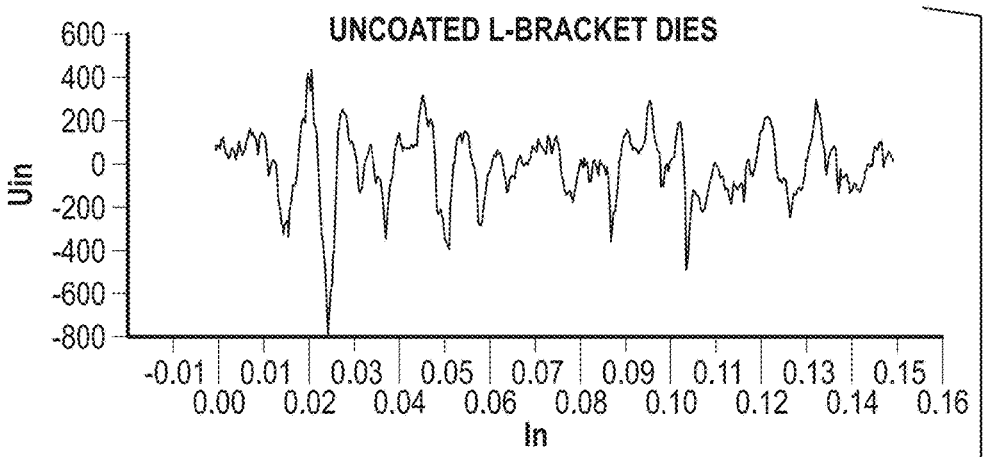
FIG. 6 is a surface roughness measurement of an L-Bracket manufactured in accordance with the present application.
Figure 7:
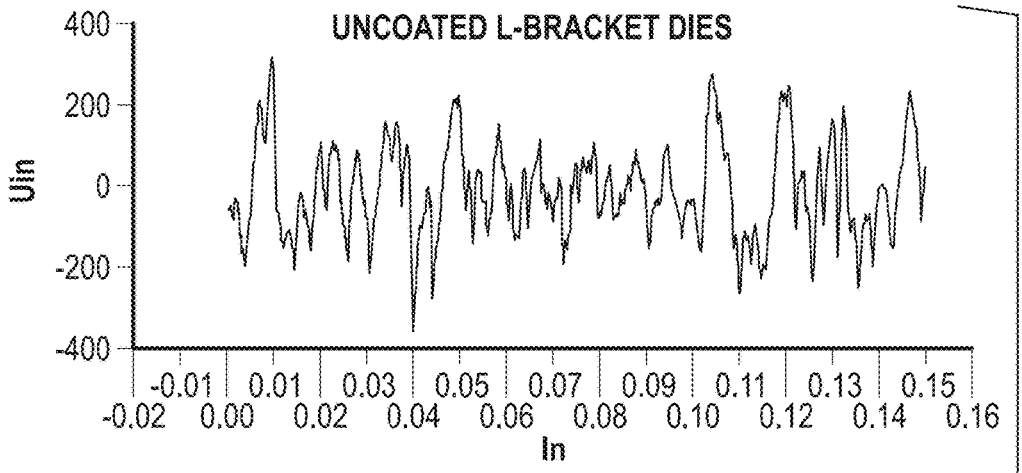
FIG. 7 is a surface roughness measurement of an L-Bracket made in accordance with the present application.
Figure 8:
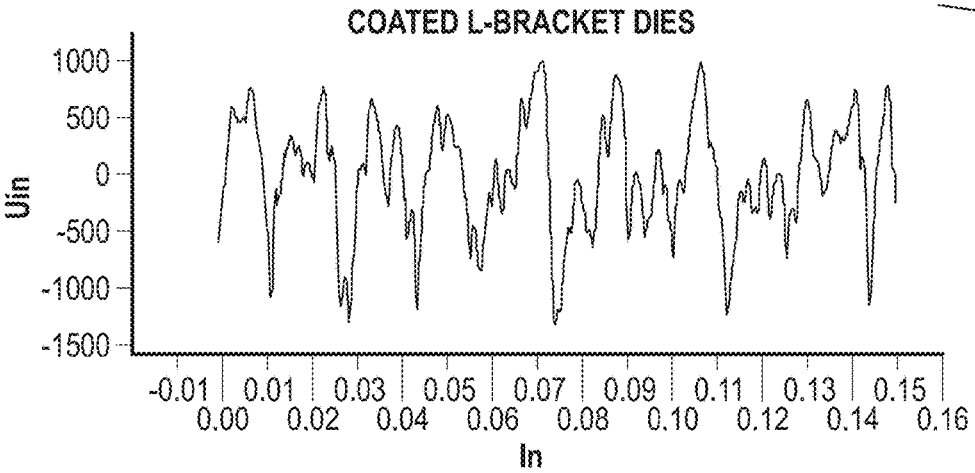
FIG. 8 Prior Art
FIG. 8 is a surface roughness measurement of an L-Bracket made with a traditional low pressure permanent mold casting having a coating or lubricant in the die cavity.
Figure 9:
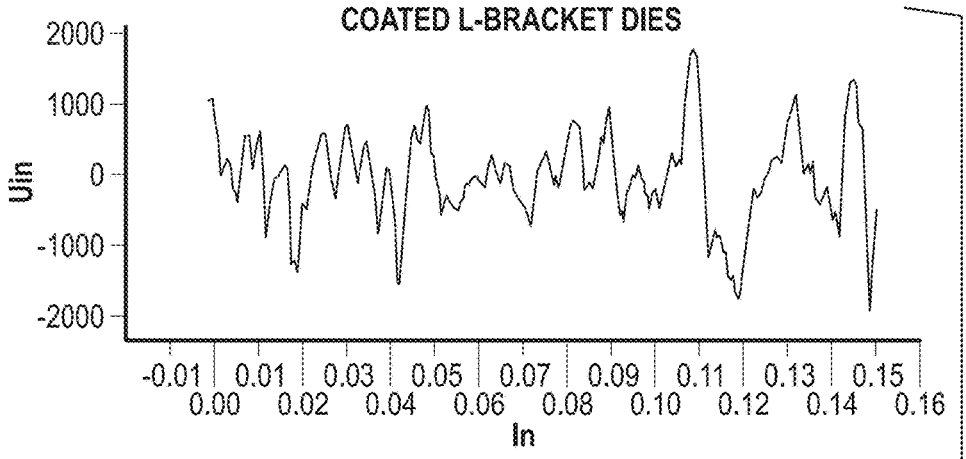
FIG. 9 Prior Art
FIG. 9 is a surface roughness measurement of an L-Bracket made with a traditional low pressure permanent mold casting having a coating or lubricant in the die cavity.

The smoothness of the respective finishes was quantified with surface roughness, of FIGS. 5-9. FIGS. 5-7 measured the surface roughness of uncoated L-bracket dies at ±500 microinches or less, while coated dies exhibited a surface roughness at ±2200 microinches $R_a$, as demonstrated by FIGS. 8-9. This means that uncoated dies result in a surface finish that is almost five times better, as the surface scans of FIGS. 5-9 indicate. More specifically, for uncoated L-bracket dies, FIG. 5 and FIG. 6 had ranges between +300 microinches $R_a$ and −300 microinches $R_a$, while FIG. 7 had a range between +250 microinches $R_a$ and −250 microinches $R_a$. For coated L-bracket dies, FIG. 8 had a range between +1,000 microinches $R_a$ and 1,200 microinches $R_a$ and FIG. 9 had a range between +1,200 microinches $R_a$ and −1,300 microinches $R_a$, demonstrating a significantly rougher finish than the uncoated die results. Accordingly, the surface roughness of castings obtained by the method and alloys of the present application is ±500 microinches $R_a$ or better.

Accordingly, by removing the coating from the dies in permanent mold casting while improving mechanical properties, the present application improves the surface aesthetics of permanent mold casting and also the ability of the casting to be extracted from the mold with low forces. The later characteristic allows the low pressure permanent casting process in accordance with the present application to be fully automated as a lower cost casting process, which is not possible with a coating because of the non-chemical sticking issue. This is all possible because a permanent mold casting alloy with die soldering resistance provided by low levels strontium, instead of high levels of iron and manganese, is utilized. When iron and manganese are used for die soldering resistance at bulk levels of 0.6% and 0.8% in structural aluminum die casting, and at 1.0% or more in conventional high pressure die casting, compounds containing these elements that decrease ductility and impact properties are visible in the microstructure. At the slower cooling rates of permanent mold casting, the iron and manganese compounds grow larger than in die casting and are more damaging to mechanical properties. By contrast, adding strontium at 0.05% to 0.08% does not result in visible compounds containing strontium in the microstructure, and so is the ideal element to provide die soldering resistance in low pressure permanent mold casting without a coating on the dies. Moreover, by removing the coating from the permanent mold dies, the casting cools faster, increasing the high mechanical properties of permanent mold castings to an even higher degree and the cycle time, which thereby reduces the manufacturing cost of permanent mold casting.

Eight inch long by ¾ inch width, flat full thickness bars (½ inch thickness), and half thickness bars (¼ inch thickness), with one-side [i.e., the 8" by ¾ inch side] containing the "as cast" surface, were cut out of the L-brackets exhibited in FIGS. 1 and 2 for testing "as cast" mechanical properties. The "as cast" mechanical properties of these two types of tensile specimens with a 2" gauge length in alloy 367 are listed in Table 4, below.

TABLE 4

| Sample | UTS [ksi] | UTS [MPa] | 0.2% Offset ksi | Yield Strength MPa | Elongation [%] | Quality Index |
|---|---|---|---|---|---|---|
| Full Flat Uncoated Dies | 29.6 | 204 | 14.84 | 102 | 6.03 | 321 MPa |
| Full Flat Coated Dies | 22.7 | 157 | 14.77 | 102 | 2.10 | 205 MPa |
| One sided-Skin Flat Uncoated Dies | 27.8 | 192 | 14.90 | 103 | 4.47 | 289 MPa |
| One sided-Skin Flat Coated Dies | 27.1 | 187 | 15.20 | 105 | 4.40 | 283 MPa |
| Averaging all Uncoated Dies | 28.7 | 198 | 14.87 | 103 | 5.25 | 306 MPa |
| Averaging all Coated Dies | 24.9 | 172 | 14.99 | 103 | 3.35 | 250 MPa |

Both the "Full Flat" samples and "One-side Skin Flat" samples had higher UTS, elongation and quality index values for Uncoated Dies than for Coated Dies. The average of the averages indicates that uncoated dies produce a 15% higher UTS, equal yield strength, 57% higher elongation and 22% higher quality index [where the quality index =UTS [in MPa]+150 log(elongation)] than coated dies.

In addition to the above, six round tensile bars (0.5 in diameter and 2" gauge length) each were cut out of the "as cast" 1¼ inch thick set sections of FIGS. 1 and 2. The mechanical properties are listed in Table 5.

TABLE 5

TENSILE PROPERTIES OF ROUND SAMPLE

| Sample | Ultimate Tensile Stress (km) | 0.2% Offset Yield Strength (ksi) | Elongation (%) |
|---|---|---|---|
| Coated Mold 1 | 23.25 | 13.92 | 2.59 |
| Coated Mold 2 | 23.6 | 14.229 | 2.6 |
| Coated Mold 3 | 23.16 | 14.236 | 2.54 |
| Coated Mold 4 | 23.54 | 14.199 | 2.6 |
| Coated Mold 5 | 22.68 | 13.832 | 2.26 |
| Coated Mold 6 | 24.18 | 14.657 | 2.47 |
| Polished Mold 1 | 23.37 | 14.085 | 2.28 |
| Polished Mold 2 | 23.93 | 14.163 | 2.49 |
| Polished Mold 3 | 24.32 | 14.271 | 2.58 |

TABLE 5-continued

TENSILE PROPERTIES OF ROUND SAMPLE

| Sample | Ultimate Tensile Stress (km) | 0.2% Offset Yield Strength (ksi) | Elongation (%) |
|---|---|---|---|
| Polished Mold 4 | 24.63 | 14.395 | 2.98 |
| Polished Mold 5 | 24.56 | 14.24 | 2.92 |
| Polished Mold 6 | 23.77 | 14.344 | 2.37 |
| Average Coated | 23.40 | 14.18 | 2.51 |
| Average Polished | 24.10 | 14.25 | 2.60 |

Using the Student's t-analysis, it was determined that the calculated t-value for the ultimate tensile stress was 2.418. The table t-value for the data in Table 5 for the degrees of freedom=6+6−2=10 is 2.228. Thus, since the calculated t value of 2.418 is greater than the table value of 2.228 for 10 degrees of freedom, we conclude that the probability of selecting from two populations with identical means and identical standard deviations is considerably less than 5%, indicating that this result is statistically significant. Accordingly, the difference between use of uncoated dies versus coated dies is sufficient to warrant the conclusion that the uncoated dies provide better mechanical properties.

The average mechanical properties of the tensile specimens having a 0.5" diameter and 2" gage length obtained from the L-brackets with and without a coating on the dies are listed in Table 6 for alloy 367 (9.1% by weight Si, 0.06% by weight Sr, 0.20% by weight Fe, 0.13% by weight Cu, 0.31% by weight Mn, 0.49% by weight Mg). The Student-t test indicates the relative ultimate tensile strengths with and without a coating are significant at the 5% level of significance for both the T61 and T62 heat treatments. Conversely, only the relative yield strength with and without a coating for the T62 heat treatment is significant at the 5% level of significance. Thus, strength properties appear to be higher when the coating is removed.

TABLE 6

MECHANICAL PROPERTIES OF ALLOY 367 MADE WITH AND WITHOUT A COATING

| Alloy and heat treatment | UTS | Yield Strength | Elongation | Quality Index |
|---|---|---|---|---|
| 367-T61 with a coating | 330 MPa (47.9 ksi) | 255 MPa (37.0 ksi) | 7.0% | 457 MPa |
| 367-T61 without a coating | 340 MPa (49.3 ksi) | 260 MPa (37.7 ksi) | 7.3% | 469 MPa |
| 367-T62 with a coating | 345 MPa (50.0 ksi) | 290 MPa (42.1 ksi) | 5.1% | 451 MPa |
| 367-T62 without a coating | 355 MPa (51.5 ksi) | 300 MPa (43.5 ksi) | 5.3% | 463 MPa |

These same mechanical properties were measured for alloy 362 (11.5% by weight Si, 0.07% by weight Sr, 0.41% by weight Fe, 0.10% by weight Cu, 0.69% by weight Mg) and an off spec 319 alloy (4.5% by weight Si, 0.05% by weight Sr, 0.45% by weight Fe, 3.9% by weight Cu, 0.40% by weight Mn, 0.14% by weight Mg) with similar results in Table 7, but the five specimen averages were from extracted bars from five separate L-bracket seats each, where the surfaces of the bars had the as cast surface of the L-bracket. Both the faster cooling rate and the smoother surface finish contributed to the higher mechanical properties for samples when the coating was removed.

TABLE 7

MECHANICAL PROPERTIES OF ALLOYS 362 & 319 MADE WITH & WITHOUT A COATING

| Alloy and heat treatment | YTS | Yield Strength | Elongation | Quality Index |
|---|---|---|---|---|
| 362-T6 with a coating | 310 MPa (45.0 ksi) | 240 MPa (34.8 ksi) | 6.0% | 427 MPa |
| 362-T6 without a coating | 320 MPa (46.4 ksi) | 250 MPa (36.3 ksi) | 6.4% | 441 MPa |
| 319-T6 with a coating | 260 MPa (37.7 ksi) | 180 MPa (26.1 ksi) | 3.0% | 300 MPa |
| 319-T6 without a coating | 270 MPa (39.2 ksi) | 190 MPa (27.6 ksi) | 3.5% | 322 MPa |

Figure 10:
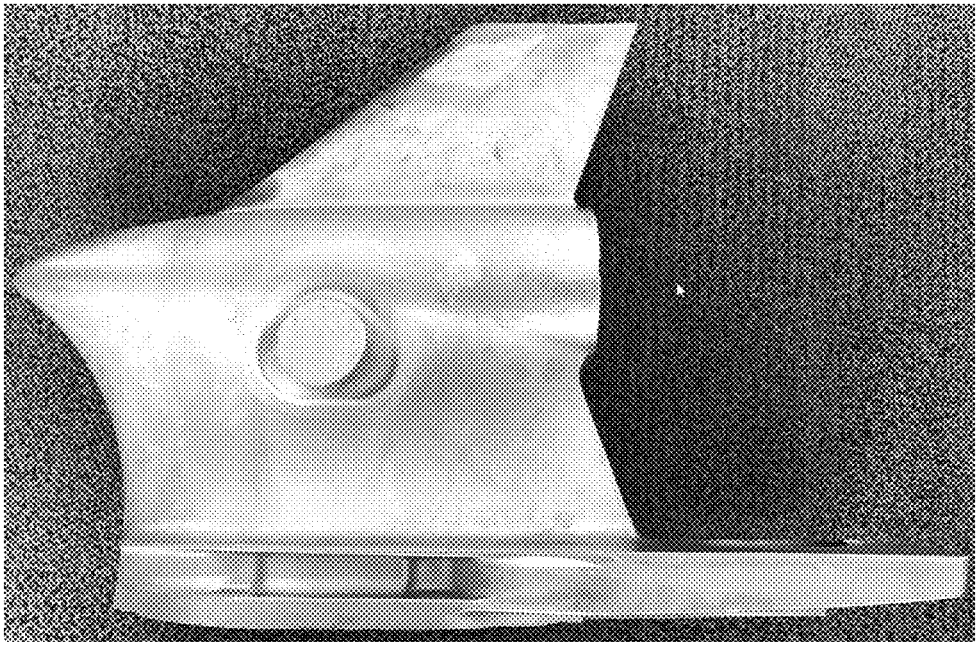
FIG. 10 is a side view of a gear case housing with having a thin integral splash plate made in accordance with the method of the present application.
Figure 11:
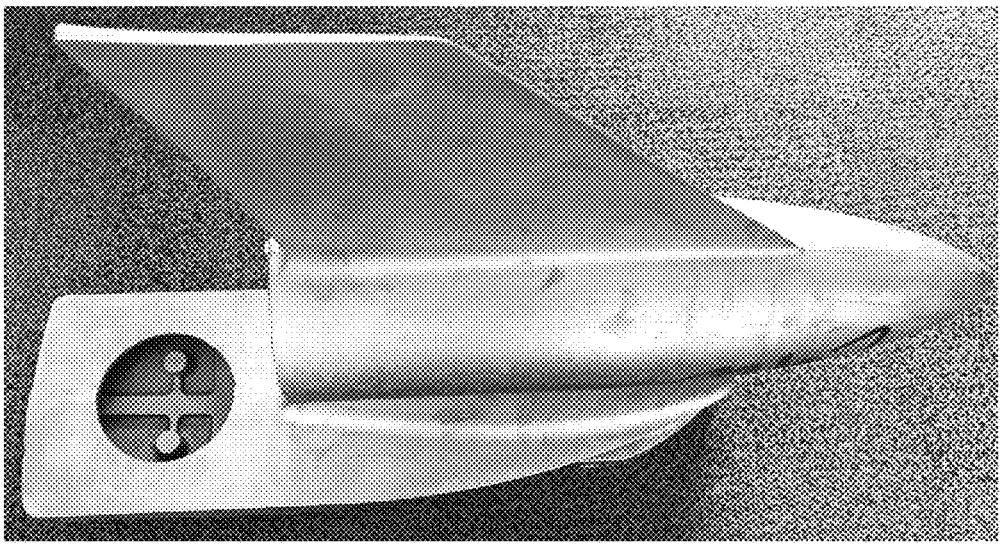
FIG. 11 is a bottom view photograph of the gear case housing of FIG. 10.
Figure 12:
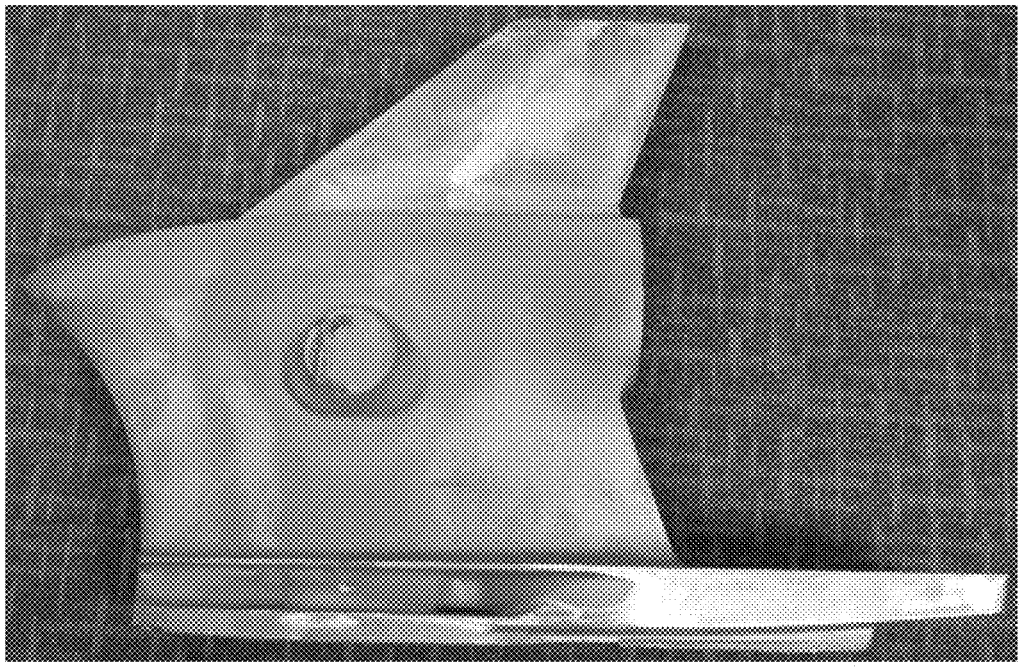
Figure 12 Prior Art
FIG. 12 is a photographic side view of a gear case housing with a thin integral splash plate made with a traditional permanent mold casting process using a die coating or lubricant.
Figure 13:
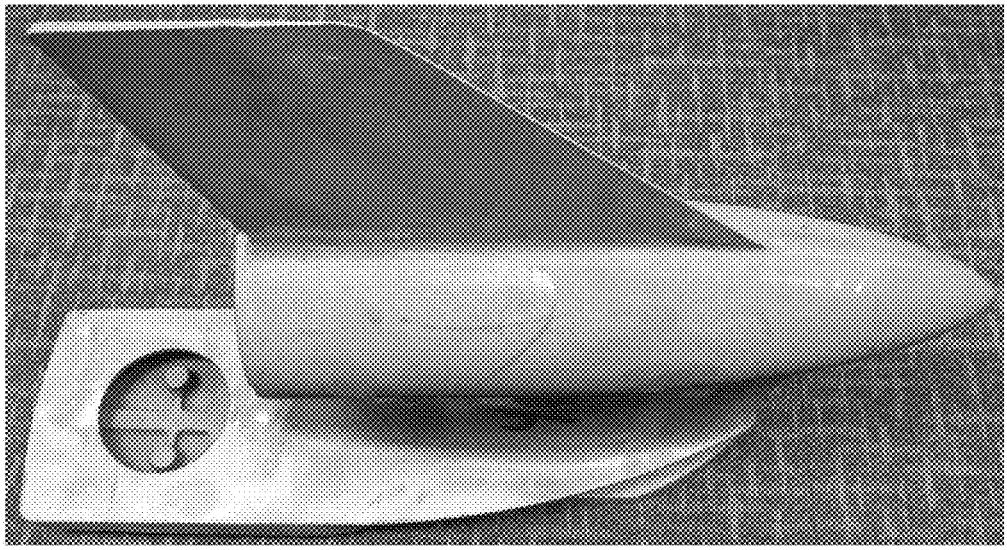
Figure 13 Prior Art
FIG. 13 is a bottom view of the gear case housing of FIG. 12.
Figure 14A:
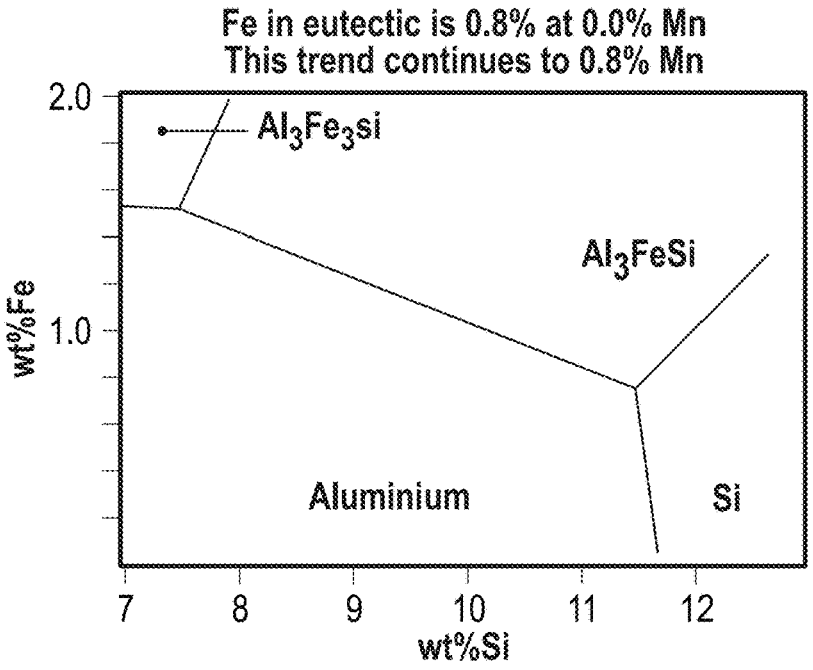
FIGS. 14A-14E are a series of phase diagrams for the aluminum-manganese-iron-silicon quaternary system.
Figure 14B:
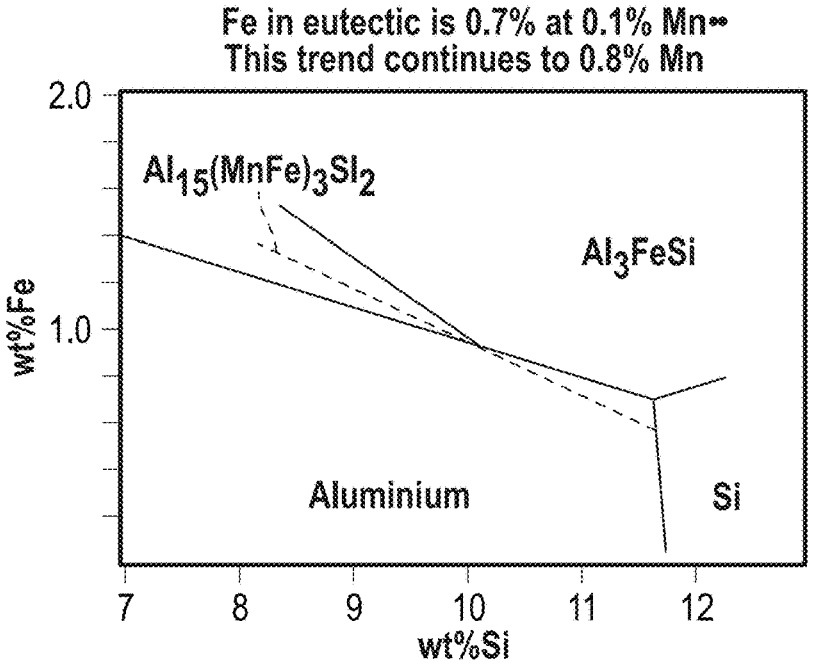
Figure 14C:
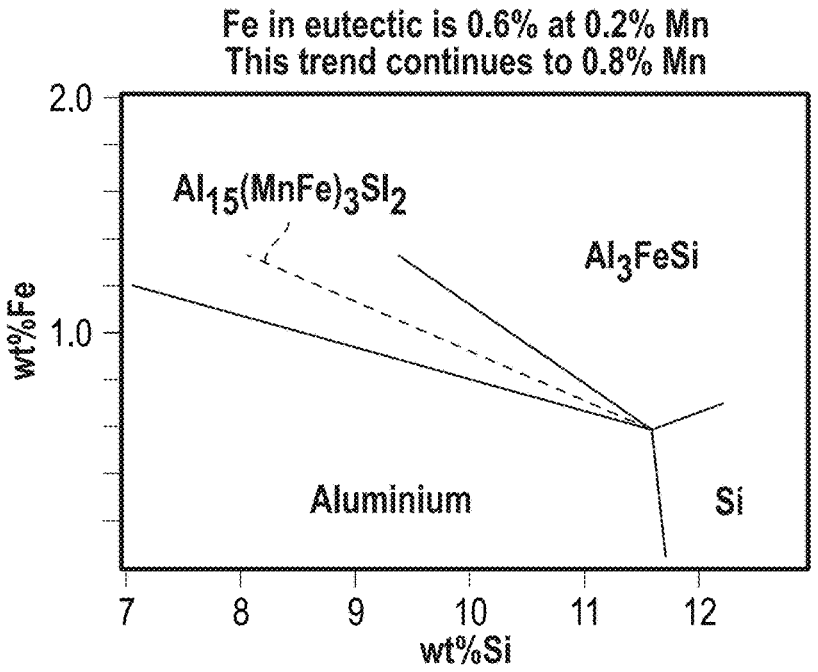
Figure 14D:
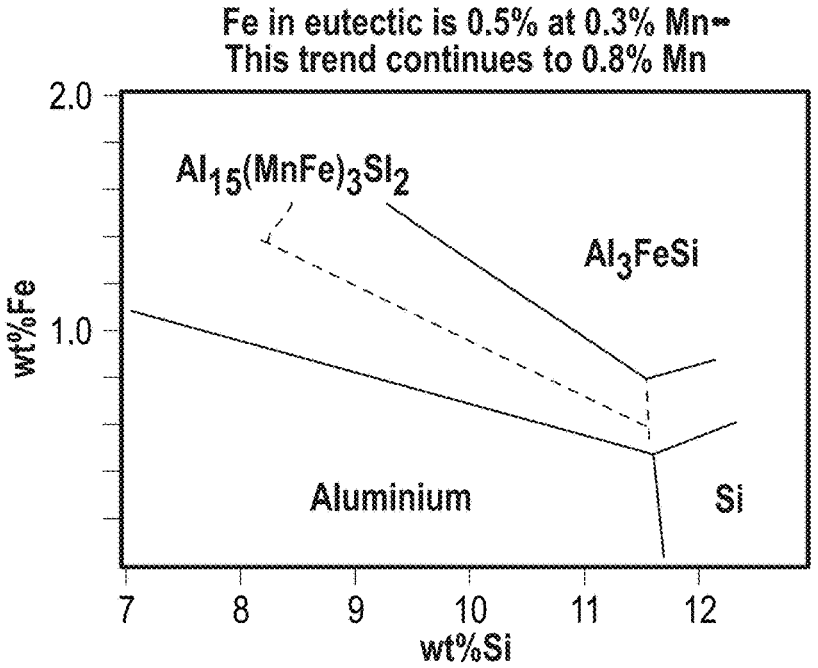
Figure 14E:
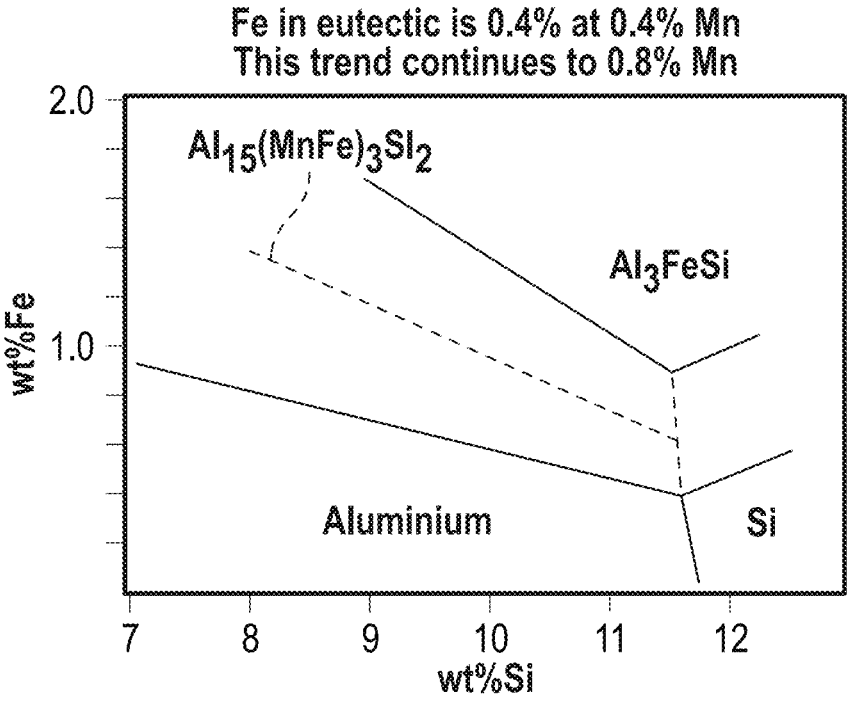

Referring now to FIGS. 10 and 11, low pressure permanent mold castings were made without a coating on the dies for a gear case housing with an integral splash plate. Both of these parts have a thin walled section perpendicular to a thick walled section, and demonstrate that a complex part configuration may be made in low pressure permanent mold without a coating on the dies. FIGS. 10 and 11 are a 35 lb. gear case housings with a thin integral splash plate made in low pressure permanent mold casting process without a coating on the dies. FIGS. 12 and 13 are similar gear cast housings with a thin integral splash plate made in low pressure permanent mold with a conventional coating on the dies and it is evident the casting surface finish is rougher and duller in color, when compared to the gearcase housings in FIGS. 10 and 11 made without a coating. Taking the coating off the dies, which was conventionally expected to extract massive amounts of heat from the molten metal during the quiescent slow filling of the low pressure permanent mold casting process, unexpectedly did not hinder filling of the dies, even the thin narrow sections perpendicular to thicker sections, before solidification starts. Conventionally the industry was discouraged even from trying to remove the die coating because die soldering was expected. Indeed, this is an issue with the current permanent mold casting process, where segments of the coating that spall off dies have to be recoated to avoid expected die soldering. Because of this expected die soldering problem when coating segments spall off the dies, one of ordinary skill in the art would not purposely remove all of the coating.

Again, it is the strontium that functions at ten times lower concentrations than either iron or manganese and provides die soldering resistance equivalent or better than iron or manganese, permitting a manganese range of 0.25-0.35% by weight and requiring an iron content below 0.45% to avoid the precipitation of primary intermetallics that makes this new innovative uncoated permanent mold die process workable.

Accordingly, a method for low pressure permanent mold casting of metallic objects is disclosed. The method contemplates preparing a permanent mold casting die that is devoid of die coating or lubrication along the die casting surface. The need for a mechanically bonded barrier coating on the steel permanent mold die for protection from die soldering by the molten alloy is simply not needed with the present application. Further, the absence of such mechanically bonded barrier coatings also cause the absence of thermal insulation, reducing the cycle time of the solidification process. The method next contemplates preparing a permanent mold casting alloy. Permanent mold casting alloy, in one embodiment, consists essentially of 4.5-11.5% by weight silicon; 0.005-0.45% by weight iron; 0.20-0.40% by weight manganese; 0.045-0.110% by weight strontium; and the balance aluminum. In another embodiment, the alloy further consists of 0.05-5% by weight copper. In yet another embodiment, the alloy further consists of 0.10-0.70% by weight magnesium. In yet another embodiment, the alloy further consists of 0.50% by weight maximum nickel, in still another embodiment the alloy further consists of 4.5% by weight maximum zinc. In yet another embodiment, the alloy may be an aluminum permanent mold casting alloy consisting essentially of 4.2-5% by weight copper; 0.005-0.15% by weight iron; 0.20-0.50% by weight manganese; 0.15-0.35% by weight magnesium; 0.045-0.110% by weight strontium; 0.05% by weight maximum nickel; 0.10% by weight maximum silicon; 0.15-0.30% by weight titanium; 0.05% by weight maximum tin; 0.10% by weight maximum zinc; and the balance aluminum.

The method of the present application contemplates pushing the prepared alloy into the permanent mold casting die under low pressure to create a permanent mold casting. The pressure may be in the range of 3-15 psi. Next, the method contemplates cooling the permanent mold casting, and removing the permanent mold casting from the die. In certain embodiments, a step of heat treating the casting is added after the step of removing the casting from the die. The method of the present invention contemplates a low pressure permanent mold casting process without coating or lubrication on the die. Since the coating of lubrication is not present, the cast product does not adhere or stick to the die it may be removed with low force. This permits the method of the present application to be fully automated, because human intervention is not needed to add the coating or to remove the casting from the die. Accordingly, one or more of the steps of preparing a permanent mold casting die, preparing an alloy, pushing the alloy into the permanent mold die, cooling the permanent mold casting, heat treating the casting, or removing the casting from the permanent mold die may be fully automated. In certain embodiments, the entire method is fully automated, while in other embodiments selected steps are automated.

When the method of the present application is utilized, the permanent mold casting does not solder to the permanent mold die. Moreover, the surface roughness of the casting is ±500 microinches $R_a$ or less. Further, the step of cooling the permanent mold casting contemplates solidifying the alloy without the formation of primarily intermetallics such as $Al_5FeSi$ or $AL_{15}(MnFe)_3Si_2$. The method may be used to create simple or complex permanent mold castings. As previously noted, the method may be used to create L brackets or gear case housings with integral splash plates.

In the instance where the present method is used to create complex castings, such as castings having at least one thin walled section, the step of pushing the alloy into the permanent mold casting die includes pushing the alloy into the thin walled sections before the alloy solidifies.

In the present disclosure, certain terms have been used for brevity, clearness and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims. Each limitation in the appended claims is intended to invoke interpretation under 35 U.S.C. § 112, sixth paragraph only if the terms "means for" or "step for" are explicitly recited in the respective limitation.

What is claimed is:

1. A method for low pressure permanent mold casting of metallic objects, the method comprising:

preparing a permanent mold casting die, said die devoid of die coating or lubrication along a die casting surface;

preparing a permanent mold casting alloy having 4.5-11.5% by weight silicon, 0.45% by weight maximum iron, 0.20-0.40% by weight manganese, 0.045-0.110% by weight strontium, 0.05-5% by weight copper, 0.10-0.7% by weight magnesium, and balance aluminum and wherein the alloy has a die soldering factor equivalent to or greater than 1.1, the die soldering factor defined as (10[Sr]+Mn+Fe);

pushing the alloy into the permanent mold casting die under pressure of 3-15 psi to create a permanent mold casting;

cooling the permanent mold casting; and removing the permanent mold casting from the die without force;

wherein the permanent mold casting does not solder to the permanent mold die; and wherein the surface roughness of the casting is ±500 microinches $R_a$ or less.

2. The method of claim 1, wherein the alloy includes 0.50% by weight maximum nickel.

3. The method of claim 1, wherein a step of heat treating the casting is added after the step of removing the casting from the die.

4. The method of claim 1, wherein the step of cooling the permanent mold casting further comprises solidifying the alloy without formation of primary intermetallics.

5. The method of claim 4, wherein the primary intermetallics are $Al_5FeSi$ or $Al_{15}(MnFe)_3Si_2$.

6. The method of claim 1, wherein the permanent mold casting is an L-bracket.

7. The method of claim 1, wherein the permanent mold casting is a gear case housing with an integral splash plate.

8. The method of claim 1, wherein the step of preparing a permanent mold casting die includes preparing a permanent mold casting die having at least one thin walled section.

9. The method of claim 8, wherein the step of pushing the alloy into the permanent mold casting die includes pushing the alloy into at least one thin walled section before the alloy solidifies.

10. The method of claim 1, wherein the method is fully automated.

11. A method for low pressure permanent mold casting of metallic objects, the method comprising:

preparing a permanent mold casting die, said die devoid of die coating or lubrication along a die casting surface;

preparing a permanent mold casting alloy having 4.2-5.0% by weight copper; 0.005-0.45% by weight iron; 0.20-0.50% by weight manganese; 0.15-0.35% by weight magnesium; 0.045-0.110% by weight strontium; 0.05% by weight maximum nickel; 0.10% by weight maximum silicon; 0.15-0.30% by weight titanium; 0.05% by weight maximum tin; 0.10% by weight maximum zinc; and balance aluminum and wherein the alloy has a die soldering factor equivalent to or greater than 1.1, the die soldering factor defined as (10[Sr]+Mn+Fe);

pushing the alloy into the permanent mold casting die under pressure of 3-15 psi to create a permanent mold casting;

cooling the permanent mold casting; and removing the permanent mold casting from the die without force;

wherein the permanent mold casting does not solder to the permanent mold die; and wherein the surface roughness of the casting is ±500 microinches or less.

12. The method of claim 11, wherein a step of heat treating the casting is added after the step of removing the casting from the die, and the steps of preparing, pushing, cooling, heat treating and removing are fully automated.

13. The method of claim 11, wherein the step of preparing a permanent mold casting die includes preparing a permanent mold casting die having at least one thin walled section, and wherein the step of pushing the alloy into the permanent mold casting die includes pushing the alloy into at least one thin walled section before the alloy solidifies.

* * * * *